US006190215B1

(12) United States Patent
Pendleton et al.

(10) Patent No.: US 6,190,215 B1
(45) Date of Patent: Feb. 20, 2001

(54) STAMPED POWER CONTACT

(75) Inventors: Christopher S. Pendleton, Carlisle; Ray C. Doutrich, Lebanon; Stuart C. Stoner, Lewisberry, all of PA (US)

(73) Assignee: Berg Technology, Inc., Reno, NV (US)

( * ) Notice: Under 35 U.S.C. 154(b), the term of this patent shall be extended for 0 days.

(21) Appl. No.: 09/101,888

(22) PCT Filed: Jan. 31, 1997

(86) PCT No.: PCT/US97/01751

§ 371 Date: Jul. 17, 1998

§ 102(e) Date: Jul. 17, 1998

(87) PCT Pub. No.: WO97/28579

PCT Pub. Date: Aug. 7, 1997

(51) Int. Cl.[7] ..... H01R 11/22

(52) U.S. Cl. ..... 439/853; 439/80; 439/857; 439/746

(58) Field of Search ..... 439/853, 851, 439/852, 856, 857, 78, 79, 80, 81, 63, 744, 746, 733.1

(56) References Cited

U.S. PATENT DOCUMENTS

| | | | | |
|---|---|---|---|---|
| 2,304,808 | | 12/1942 | Draving | 439/748 |
| 2,352,618 | | 7/1944 | Daenz | 439/683 |
| 2,472,131 | | 6/1949 | Toth et al. | 439/683 |
| 3,026,496 | | 3/1962 | Gluck | 439/683 |
| 3,083,351 | | 3/1963 | Nielsen, Jr. et al. | 439/851 |
| 3,601,775 | | 8/1971 | Longenecker | 439/636 |
| 4,333,702 | * | 6/1982 | Hermann, Jr. | 439/567 |
| 4,341,434 | | 7/1982 | Pfister | 439/839 |
| 4,620,766 | | 11/1986 | Leonard | 439/748 |
| 4,702,707 | | 10/1987 | Hillbish | 439/80 |
| 4,776,651 | | 10/1988 | Paulo | 439/857 |
| 4,784,623 | | 11/1988 | Beck, Jr. et al. | 439/872 |
| 4,906,212 | * | 3/1990 | Mixon, Jr. | 439/857 |
| 5,046,952 | * | 9/1991 | Cohen et al. | 439/63 |
| 5,077,893 | | 1/1992 | Mosquera et al. | 29/882 |
| 5,151,056 | | 9/1992 | McClune | 439/851 |
| 5,194,022 | | 3/1993 | Enomoto | 439/851 |
| 5,362,244 | * | 11/1994 | Hanson et al. | 439/856 |
| 5,376,012 | | 12/1994 | Clark | 439/80 |
| 5,489,222 | | 2/1996 | Moyer et al. | 439/748 |
| 5,489,223 | | 2/1996 | Faji et al. | 482/129 |
| 5,667,392 | * | 9/1997 | Kocher et al. | 439/733.1 |

OTHER PUBLICATIONS

DuPont Electronics Interconnect & Packaging Catalog, Aug. 1988, pp. 334–335.

DuPont HPC Connector System Bulletin 712, Jan. 1987, pp. 6, 12, 15, 18.

* cited by examiner

*Primary Examiner*—Paula Bradley
*Assistant Examiner*—Tho D. Ta
(74) *Attorney, Agent, or Firm*—Brian J. Hamilla; M. Richard Page

(57) ABSTRACT

A power port terminal formed by stamping from a blank of conductive material comprises a contact receiving socket portion (12) and an integral mounting portion (14). The socket includes a web with a plurality of beams (20) thereon. The inner surface of the beams on the bends thereof define a substantially continuous cylindrical contact surface at a predetermined point along the reference axis of the terminal. The contact surface has a predetermined constricted dimension (36) measured in a plane perpendicular to the reference axis, this dimension being the most constricted dimension along the reference axis of the terminal. The terminal is thereby able to accommodate a pin of any desired axial length. The trailing mounting legs (46) thereon, that in the preferred instance, extend generally perpendicular to the reference axis of the terminal. Latch tabs (38) may be provided on one or more of the beams. There are lateral projections (62) on the mounting portion, which restrain the terminal from pivoting on its longitudinal axis when it is mounted in a through hole (52) in an insulative housing (50).

19 Claims, 4 Drawing Sheets

STAMPED POWER CONTACT

BACKGROUND OF THE INVENTION

1. Field of the Invention

The present invention relates to a socket-type terminal for use in effecting a relatively high-amperage power connection with a male pin of any desired length.

2. Brief Description of Prior Developments

A power port terminal for interconnecting a backplane with a male pin plug may be formed in any one of a variety of ways. U.S. Pat. No. 4,702,707 illustrates a power terminal that includes a base to which a mating component having a socket may be attached. In this terminal the base and a portion of the mating component are formed as screw machined parts. U.S. Pat. No. 4,749,357 shows a power connector in which a socket defined from a crown band of spring contact beams is inserted into a block of conductive material. In both of these arrangements the contact beams of the terminal extend around the entire 360° periphery of the male pin. However, since one end of the terminal is closed, the socket may accept a pin having only a predetermined limited axial dimension.

The power terminal shown at page 334, 335 of the Du Pont Electronics Interconnect and Packaging Catalog, August 1988, is also a machined part having a socket that may accept a pin having only a predetermined limited axial dimension. This part also includes a snapring latch arrangement which is received about the socket of the terminal and which cooperates with a housing to retain the terminal.

The terminal shown in U.S. Pat. No. 4,002,400, assigned to the assignee of the present invention, is formed from a stamped blank of conductive material. Again, however, it appears that the socket portion of the terminal is blocked at an axially rearward point by a wire crimp barrel and an insulation crimp barrel, effectively limiting the axial dimension of a pin receivable in the socket.

The power terminal forming a part of the Du Pont HPC Connector System, as shown at page 6 of Bulletin 7121, January 1987, is fabricated from a stamped blank of conductive material. Although in this terminal the length of the pin receivably by the socket is not limited, the socket region does not fully surround the pin when the same is received therein.

U.S. Pat. 5,376,012, the contents of which are incorporated herein by reference, discloses a power port terminal which is formed by stamping from a blank of conductive material. The socket includes a web with a plurality of beams. The inner surface of the beams define a substantially continuous cylindrical contact surface. The trailing mounting portion has a set of mounting legs. While this contact provides a socket formed from a stamped conductive material that both surrounds a male pin over substantially 360° of its periphery and does not limit the axial length of pin receivable therein, it has been found that this contact may tend to pivot on its longitudinal axis when it is mounted in a through hole of an insulative housing.

A need, therefore, exists for a stamped power contact which does not pivot on its longitudinal axis. A need also exists for such a stamped power contact which is not subject to being overextended into the through hole of the insulative housing in which it is mounted.

SUMMARY OF THE INVENTION

The present invention relates to a power port terminal formed by stamping from a blank of conductive material.

The terminal comprises a contact receiving socket portion and an integral mounting portion. The terminal has a reference axis extending therethrough. The contact receiving socket portion includes a web with a plurality of beams thereon. When the terminal is formed the beams cooperate to form an axially extending tubular socket region. The inner surface of the beams on the bends thereof define a substantially continuous cylindrical contact surface at a predetermined point along the reference axis within the tubular region. The contact surface is interrupted only by the spacing between the beams and is thus adapted to surround a male pin over 360° of its periphery. The cylindrical contact surface has a predetermined constricted dimension measured in a plane perpendicular to the reference axis, this dimension of the substantially continuous cylindrical contact surface being the most constricted dimension along the reference axis of the terminal. The terminal is thereby able to accommodate a pin of any desired axial length.

The trailing mounting portion has a set of mounting legs thereon. The mounting legs depend from the lateral flanges of a curved hood portion. The hood and flanges preferably surround substantially 270° of the periphery of the pin. In the preferred instance the mounting legs extend generally perpendicular to the reference axis of the terminal. Lateral projections also depend from the hood to restrain the terminal from pivoting about its longitudinal axis.

One or more of the beams may have a latch tab thereon. The latch tabs engage with ribs provided in the terminal housing to secure the terminal therewithin.

BRIEF DESCRIPTION OF THE DRAWINGS

The invention will be more fully understood from the following detailed description thereof taken in connection with the accompanying drawings, which form a part of this application and in which.

DETAILED DESCRIPTION OF THE PREFERRED EMBODIMENTS

Figure 2:
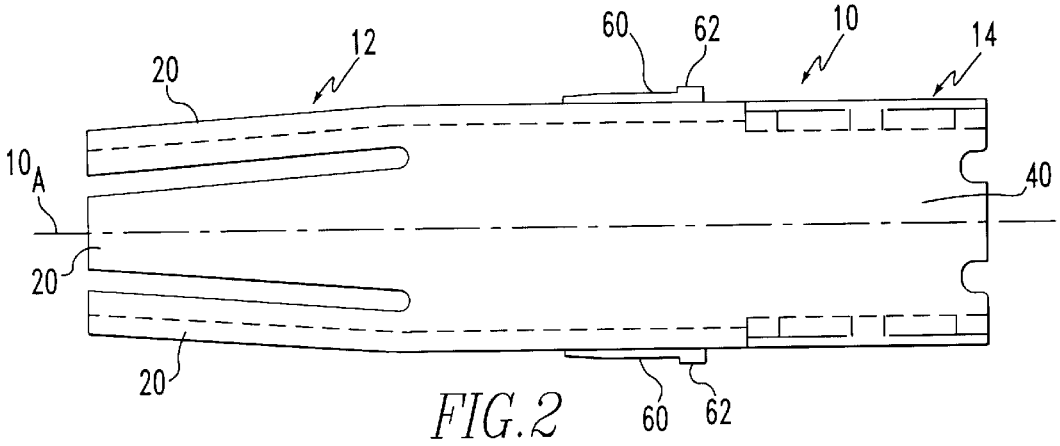
FIG. 2 is a top plan view of the terminal shown in FIG. 1.

Throughout the following detailed description similar reference numerals refer to similar elements in all figures of the drawings.

Figure 1:
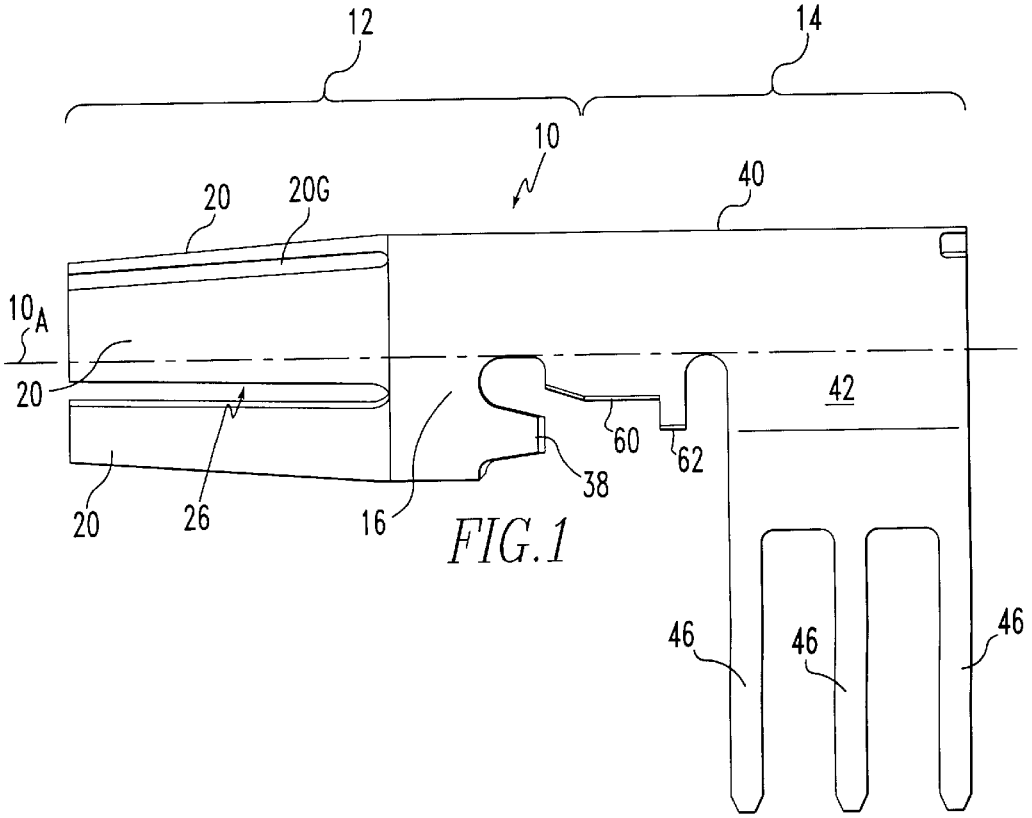
FIG. 1 is a side elevational view of a preferred embodiment of the terminal of the present invention.
Figure 6:
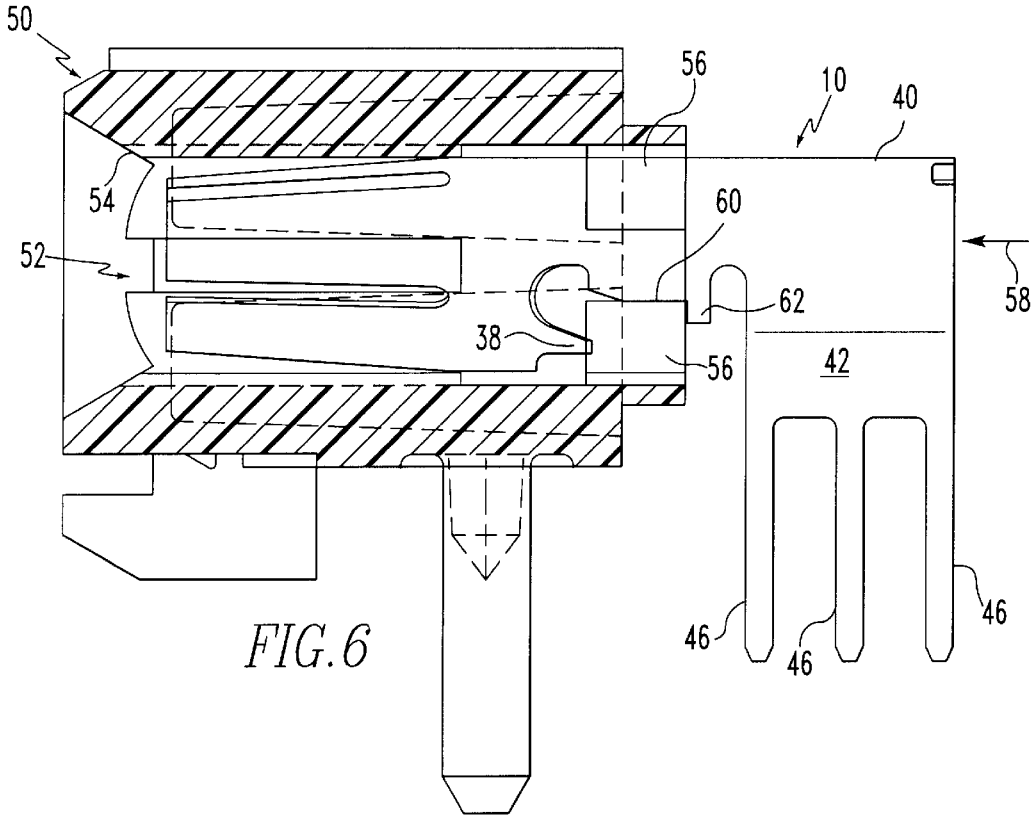
FIG. 6 is a side elevational view of the contact and housing shown in FIG. 5 wherein the housing is in vertical cross section.

With reference to FIGS. 1 and 2 shown is a power port terminal generally indicated by reference character 10 in accordance with the present invention. The terminal 10 is formed by stamping from a blank of a suitable conductive material, such as beryllium copper material. A developed view of the blank is illustrated in FIG. 6. The terminal 10 includes a contact receiving portion 12 and an integral mounting portion 14. A reference axis 10A extends through the terminal 10.

The contact receiving portion 12 includes a web 16 from which extend a plurality of beams, or fingers, 20. The beams are preferably equiangularly arranged about the axis 10A. In the embodiment illustrated five beams 20 are shown, each beam being angularly separated from the angularly adjacent beam by a gap 20G . When the terminal 10 is fully formed (in a manner to be described) each of the beams 20 has a curved inside surface 20S with a lip 20B or alternatively an inward bend located axially therealong.

Figure 3:
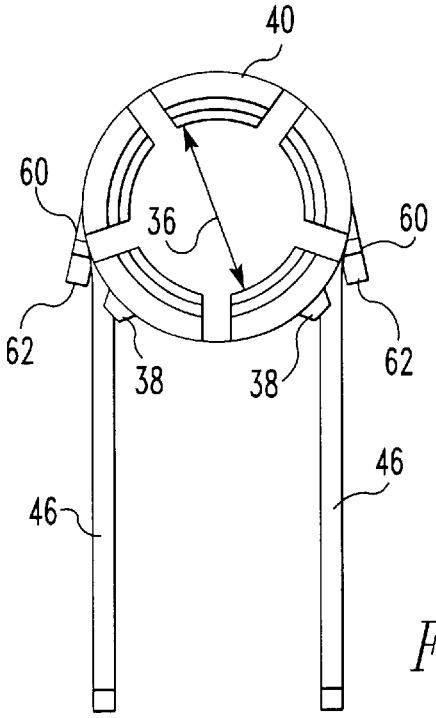
FIG. 3 is a front end view of the terminal shown in FIG. 1.

The beams 20 cooperate to form an axially extending tubular socket region 26. The socket region 26 is thus adapted to surround a male pin guided therein over 360° of its periphery. The inner surface 20S of the beams 20 define a substantially continuous cylindrical contact surface 28 lying at a predetermined point 30 along the reference axis 10A within the tubular socket region 26. The contact surface 28 is, as may be best seen in FIGS. 3 and 4, interrupted only by the gap 20G between angularly adjacent beams 20.

The cylindrical contact surface 28 defined by the lips 20B of each beam 20 defines a circle centered on the reference axis 10A of the terminal. The surface 28 thus imparts a predetermined constricted dimension 36 (i.e., the diameter of the surface 28) measured in a plane perpendicular to the reference axis 10A. This dimension 36 of the substantially continuous cylindrical contact surface 28 is the most constricted dimension along the reference axis 10A of the terminal. The through bore of the socket region 26 of the terminal 10 is thus effectively unlimited. The terminal 10 is thereby able to accommodate a pin of any desired axial length.

In the preferred embodiment two of the beams 20 are provided with latch tabs 38. As may be seen in FIG. 3 the tabs 38 extend outwardly beyond the basic outer diametric dimension of the contact receiving portion 12. As an alternative it should be understood that only a single latch tab or more than two latch tabs may be provided as desired. The tabs 38 may be conveniently located on any of the beams 20. In the preferred arrangement the tab(s) 38 are formed as appendages disposed axially between the laterally outward beam(s) 20 and the mounting portion 14. The tabs 38 may be additionally or alternately formed by punching through the material of the web 16.

Figure 4:
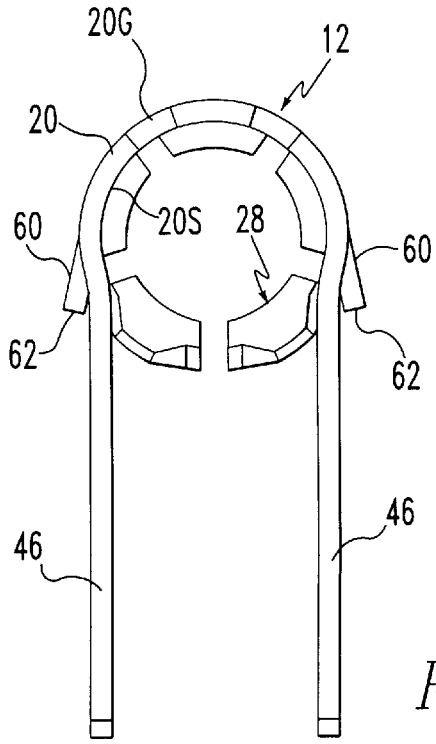
FIG. 4 is a rear end view of the terminal shown in FIG. 1.
Figure 5:
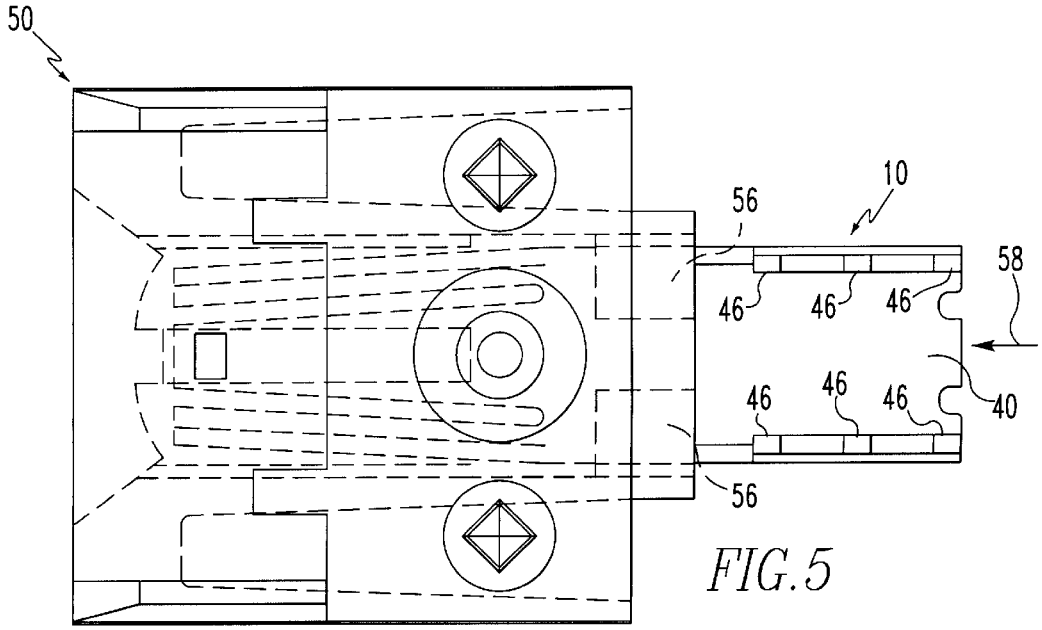
FIG. 5 is a bottom plan view of the terminal shown in FIG. 1 as inserted in an insulative housing.

The trailing mounting portion 14 extends rearwardly from the web 16. The mounting portion 14 includes a hood region 40 melding into a pair of lateral flanges 42. As is best seen in FIG. 4 and 5 the hood 40 and the flanges 42 preferably extend substantially 270° about the reference axis 10A of the terminal 10. A plurality of mounting legs 46 depending from each flange 42 defines a set of mounting legs for the terminal 10. The mounting legs 46 each extend downwardly a substantial distance below the contact receiving portion 12.

In the preferred embodiment, the mounting legs extend generally perpendicularly to the reference axis 10A of the terminal. The mounting legs 46 may be received by plated through bores provided in the surface of a substrate whereby electrical interconnection may be effected between the terminal 10 and a backplane on the substrate. It should be understood that is within the contemplation of the present invention to arrange the legs 46 such that they align parallel to the reference axis 10A of the terminal.

The terminal 10 would preferably be formed from a blank (not shown). The blank is attached to a carrier strip (not shown) by a tail (not shown). The blank is made by a stamping operation and the terminal 10 is formed therefrom by bending the blank over a mandrel, as is understood by those skilled in the art.

Figure 7:
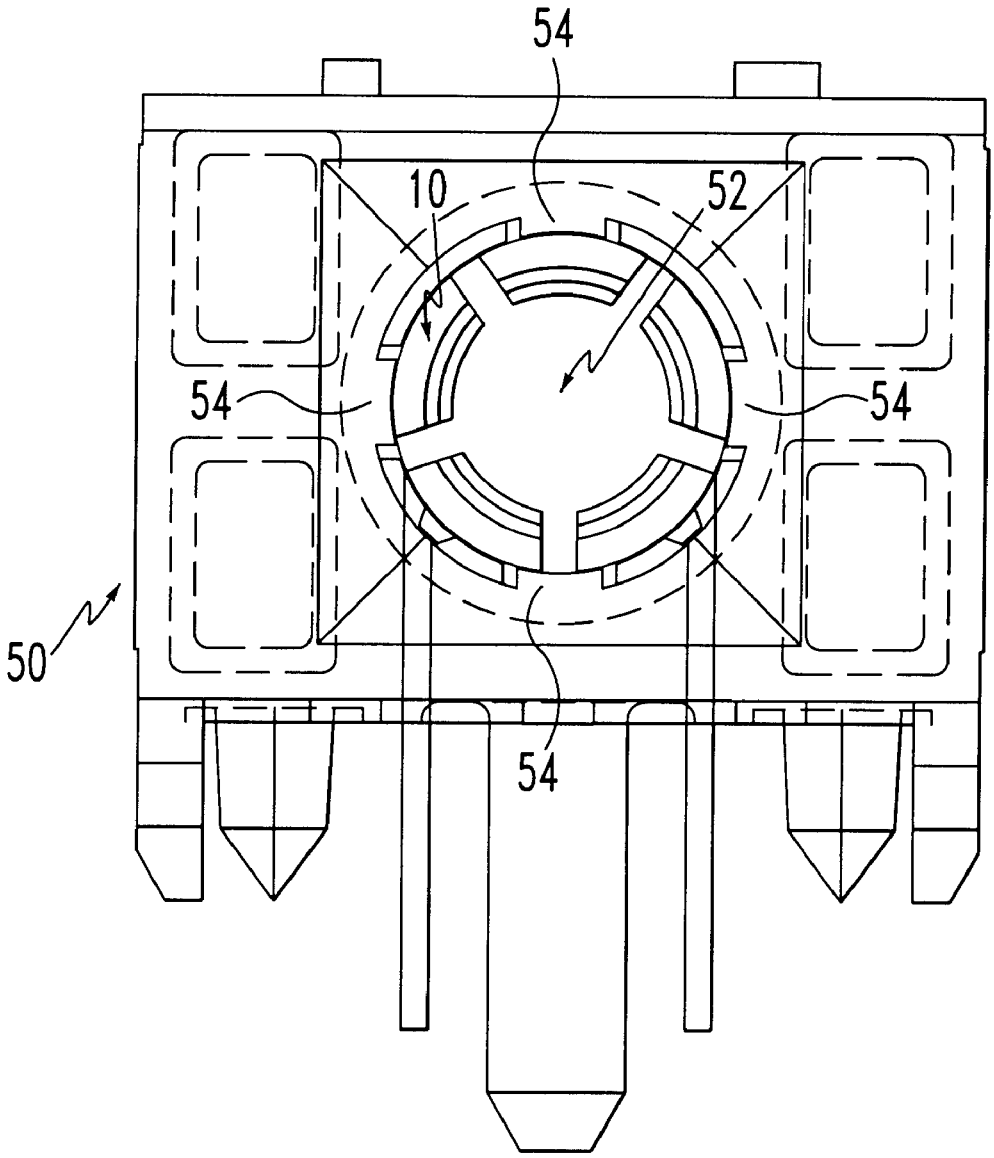
FIG. 7 is a front end view of the housing and contact shown in FIG. 5.

With reference to FIGS. 5–7 the terminal 10 is received within a housing 50 formed from a block of a suitable insulating material. The housing 50 has a through passage 52 therein. Locating guide members 54 extend axially along the walls of the passage 52 to position the terminal 10 within the housing. Locking ribs 56 are disposed about the rear end of the through hole 52. The terminal 10 is inserted into the passage 52 in the housing 50 in the direction of the arrow 58. The latches 38 on the beams 20 are resiliently deflected as the terminal 10 is inserted into the housing 50. Once axially past the locking ribs 56 the latches 38 snap into locking position behind the locking ribs 56. The circumferential extend of the locking ribs 56 is such that the tabs 38 will engage against a rib 56 to retain the terminal 10, once inserted, within the housing 50.

Since the dimension 36 of the surface 28 is the most constricted dimension of the socket, a terminal 10 in accordance with the present invention presents no impediment to the axial advance of a male pin. Thus a pin having any desired length may be received coaxially with the reference axis of the terminal. Such a capability is believed advantageous when using the terminal of the present invention in a so-called "first make-last break" interconnection system.

Referring to FIGS. 1–4 and 6, resilient lateral projections 60 extend from the hood 40 of the mounting portion 14. To the rear of these lateral projections 60 there are appendages 62. Referring particularly to FIG. 6, it will be seen that the resilient lateral projections 60 engage locking ribs 56. It will be understood that the lateral projections 60 on the opposed sides the opposed sides of the terminal 10 each engage a locking rib 56 so as to prevent or significantly reduce pivotal motion of the terminal 10 in the through hole 52 of the insulative housing 50. It will also be appreciated that the appendages 62 extend outwardly from the lateral projections 60 so as to abut the rear of the insulative housing and prevent the terminal 10 from being overextending into the though hole 52.

It will be appreciated that a stamp power contact has been described which is not subject to undo pivoting motion in the through hole of an insulative housing in which it is mounted. It will also be appreciated that this stamp power contact is not subject to being overextended into the through hole of the insulative housing.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A female-type power port terminal for connecting to a male plug of a wide range of lengths and cross-sectional dimensions, comprising:

a contact receiving portion having a web and a plurality of fingers that are unitary with said web, said fingers being arranged to form an axially extending socket that is aligned about a reference axis, each of said fingers having a free end that is distal from said web, said free ends being unconnected to each other except through said web, each of said fingers being angled towards the reference axis with said free end inwards from said web, said fingers together defining a contact surface that is constructed and arranged to contact the male plug that is inserted into said socket, said contact surface being most constricted along said reference axis in said terminal at a point proximate the free ends of the fingers; and a mounting portion that is unitary with and extends longitudinally from said contact receiving portion and is formed together with said contact receiving portion from a single blank of conductive material, said mounting portion comprising a hood region that is curved about said reference axis by substantially 270 degrees to define a space that is coextensive and aligned with said socket, said hood region being open at least to permit a plug to pass into said space, said mounting portion further comprising a plurality of mounting legs thereon for mounting the terminal on a substrate; whereby said terminal, as a result of said unconnected free ends, is constructed to accept different male plugs within a wide range of cross-sectional dimensions, and, as a result of said open space defined by said hood region, is constructed to accept different male plug having a wide range of lengths and wherein said hood region has at least one lateral projection projecting laterally outwards from the hood region and ending in a free edge that is distal to the hood region.

2. The power port terminal of claim 1 wherein at least one of the fingers has a latch tab thereon.

3. The power port terminal of claim 1 wherein at least two of the fingers has a latch tab thereon.

4. The power port terminal of claim 1 wherein at least one of the fingers has a latch tab thereon.

5. The power port terminal of claim 1 wherein at least two of the fingers has a latch tab thereon.

6. The terminal of claim 1 wherein the hood region has another lateral projection projecting from the hood region and forming with the at least one lateral projection a pair of opposed lateral projections on the hood region.

7. The terminal of claim 1 wherein the at least one lateral projection extends downwardly from the hood region.

8. The power port terminal of claim 1 wherein the mounting legs extend generally perpendicularly to the reference axis.

9. The power port terminal of claim 8 wherein at least one of the fingers has a latch tab thereon.

10. The power port terminal of claim 8 wherein at least two of the fingers has a latch tab thereon.

11. The terminal of claim 1 wherein the terminal is mounted in a through hole in an insulative housing.

12. The terminal of claim 11 wherein there is at least one rib in the through hole of the insulative housing and the at least one lateral projection engages said at least one rib.

13. The terminal of claim 11 wherein the at least one lateral projection has an appendage depending from the distal edge of the at least on lateral projection, which appendage prevents the terminal from being over extended in the through hole.

14. A female-type power port terminal for connecting to a male plug of a wide range of lengths and cross-sectional dimensions, comprising:

a contact receiving portion having a web and a plurality of fingers that are unitary with said web, said fingers being arranged to form an axially extending socket that is aligned about a reference axis, each of said fingers having a free end that is distal from said web, said free ends being unconnected to each other except through said web, each of said fingers being angled towards said reference axis with said free end inwards from said web, said fingers together defining a contact surface that is constructed and arranged to contact the male plug that is inserted into said socket, said contact surface being most constricted along said reference axis in said terminal at a point proximate the free ends of the fingers; and a mounting portion that is unitary with and extends longitudinally from said contact receiving portion and is formed together with said contact receiving portion from a single blank of conductive material, said mounting portion comprising a hood region that is curved about said reference axis to define a space that is coextensive and aligned with said socket, said hood region being open at least to permit a plug to pass into said space and said hood region has at least one lateral projection projecting laterally outward from the hood region and ending in a free edge that is distal to the hood region;

said mounting portion further comprising at least three mounting legs thereon for mounting the terminal on a substrate, said mounting legs each extending downwardly a substantial distance below said contact receiving portion; whereby said terminal, as a result of said unconnected free ends, is constructed to accept different male plugs within a wide range of cross-sectional dimensions, and, as a result of said open space defined by said hood region, is constructed to accept different male plugs with a wide range of lengths.

15. The terminal of claim 14 wherein the hood region has another lateral projection projecting laterally from the hood region and forming with the at least one lateral projection a pair of opposed lateral projections on the hood region.

16. The terminal of claim 14 wherein the at least one lateral projection extends downwardly from the hood region.

17. The terminal of claim 14 wherein the terminal is mounted in a through hole of an insulative housing.

18. The terminal of claim 17 wherein there is at least one rib in the through hole of the insulative housing and the at least one lateral projection engages said at least one rib.

19. The terminal of claim 17 wherein the at least one lateral projection has an appendage depending from the distal edge of the at least one lateral projection, which appendage prevents the terminal from being overextended in the through hole.

* * * * *